United States Patent [19]

Feyerl et al.

[11] Patent Number: 4,632,325

[45] Date of Patent: Dec. 30, 1986

[54] APPARATUS FOR UNWINDING A NONWOVEN FIBROUS WEB FROM A ROLL THEREOF

[75] Inventors: Günther Feyerl, Linz; August Kalteis, Traun; Karl Meyer, Linz, all of Austria

[73] Assignee: Textilmaschinenfabrik Dr. Ernst Fehrer Aktiengesellschaft, Leonding, Austria

[21] Appl. No.: 556,913

[22] Filed: Dec. 1, 1983

[30] Foreign Application Priority Data

Dec. 22, 1982 [AT] Austria ..... 4630/82

[51] Int. Cl.[4] ..... B65H 16/02; B65H 18/26

[52] U.S. Cl. ..... 242/55; 242/65; 242/68.7; 242/75.2

[58] Field of Search ..... 242/55, 65, 66, 68.7, 242/75.1, 75.2, 67.1 R

[56] References Cited

U.S. PATENT DOCUMENTS

| | | | |
|---|---|---|---|
| 3,306,547 | 2/1967 | Reid et al. | 242/66 |
| 3,568,944 | 3/1971 | Besserdich | 242/66 |
| 4,150,797 | 4/1979 | Kataoka | 242/67.1 R |
| 4,434,949 | 3/1984 | Karr | 242/66 |

FOREIGN PATENT DOCUMENTS

| | | | |
|---|---|---|---|
| 2020283 | 11/1971 | Fed. Rep. of Germany | 242/66 |
| 1180985 | 2/1970 | United Kingdom . | |

*Primary Examiner*—John M. Jillions
*Attorney, Agent, or Firm*—Kurt Kelman

[57] ABSTRACT

Apparatus for unwinding a nonwoven fibrous web from a roll thereof comprises a roll-bearing for supporting said roll on the underside of its periphery and a core-mounting in which the core of said roll is mounted to be adjustable in elevation relative to the roll-bearing. Said core-mounting is adjustable by a positioning drive under the control of a controller. To avoid an application of excessive loads to the web between the roll and the roll-bearing, the positioning drive is controlled by the controller in dependence on the pressure applied by the roll to the roll-bearing.

4 Claims, 3 Drawing Figures

APPARATUS FOR UNWINDING A NONWOVEN FIBROUS WEB FROM A ROLL THEREOF

Figure 1:
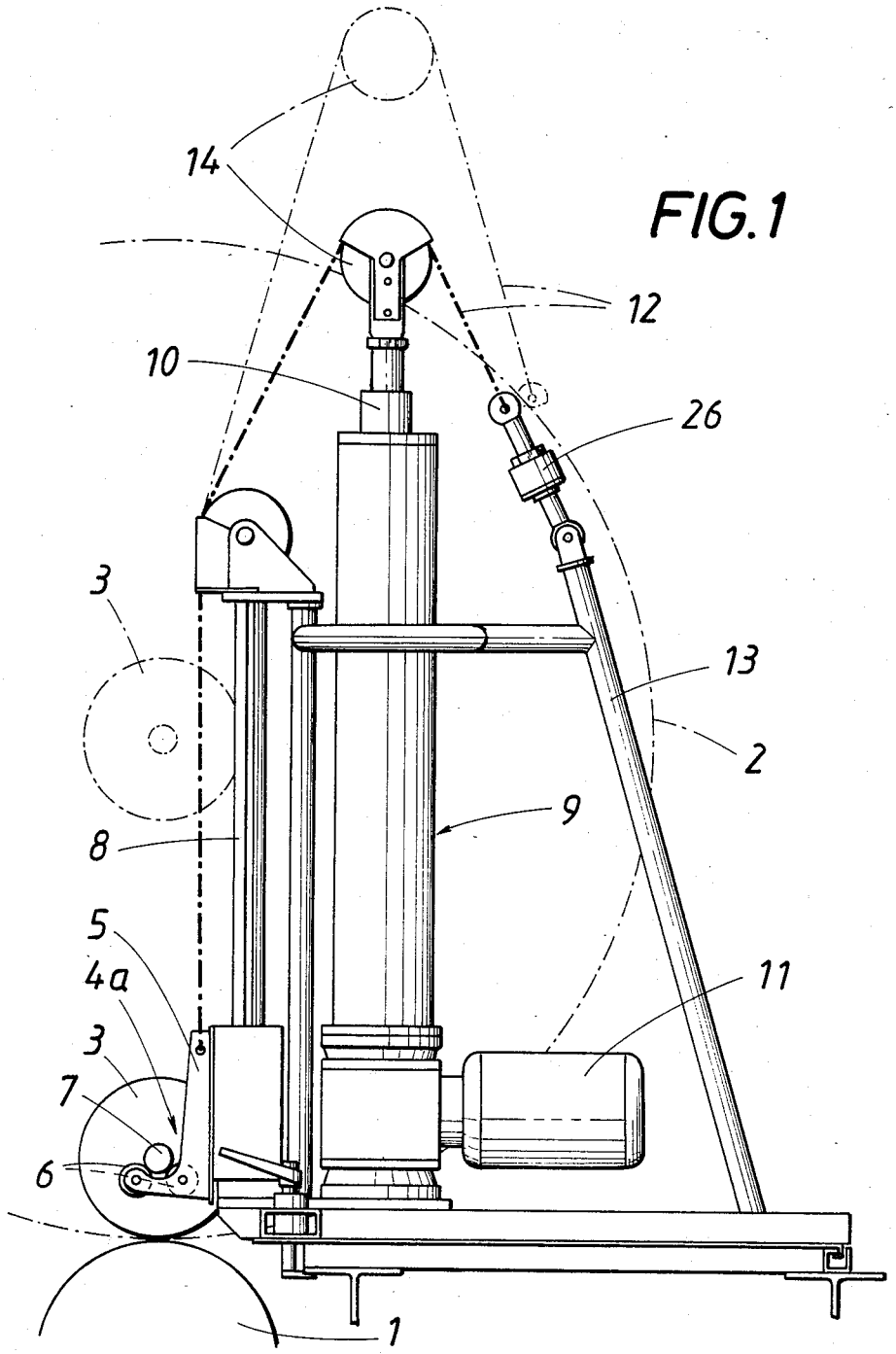

This invention relates to apparatus for unwinding a nonwoven fibrous web from a roll thereof, comprising roll-bearing means for supporting the roll on the underside of its periphery, core-mounting means for mounting the core of the roll so that it is displaceable in elevation relative to said roll-bearing means, and positioning drive means for adjusting said core-mounting means under the control of a controller. The core-mounting means comprises preferably two core bearings which are adjustable in elevation.

In apparatus of that kind the core-mounting means usually has a vertical guide for the core and the latter is freely held in said guide to be freely movable along the same so that, during a withdrawal of the web from the roll which rests on the roll-bearing means, the core can descend toward the roll-bearing means as the radius of the roll is decreased. In that operation the web to be unwound is urged by the roll against a moving blanket, which may consist of a conveyor belt, a woven fabric or a felt belt and extends between the roll-bearing means and the roll and carries the web along and imparts to the roll the rotation which is required to unwind the web. In such apparatus the velocity at which the web is unwound depends on the speed of travel of the blanket. A disadvantage of said known apparatus resides in that the web being unwound is loaded by the weight of the roll and this may result in disturbing deformations of the web if the roll is rather heavy.

To ensure that a web of woven fabric which is being unwound from a roll thereof is in a predetermined position relative to a conveyor, it is known from British Patent Specification No. 1,180,985 to hold the core of the roll in two core bearings, which are adjustable in elevation and are connected by a chain to a positioning drive and can be adjusted by the latter under the control of a controller so that the roll core can be lowered during the unwinding operations as the diameter of the roll of woven fabric is decreased. For this purpose a control switch is provided, which can be actuated by one of two pivoted arms which are supported by means of springs and each of which carries a roller for engaging the roll of woven fabric which is to be unwound. When the diameter of the roll has been reduced to such an extent by the unwinding operation that the spring-loaded pivoted arms are pivotally raised, then the control switch will be actuated and the positioning drive will lower the rolls of woven fabric until the control switch is released. In such an arrangement the position of the roll will depend on the contact travel of the control arm and on the inertia of the positioning drive so that the pressure applied by the roll of woven fabric to a stationary roll-bearing means will vary in spite of the fact that the position of the web of woven fabric unwound from the roll remains approximately constant. In the unwinding of nonwoven fibrous webs from a roll, such pressure variations may impose undesirable loads on the nonwoven fibrous web.

It is an object of the invention to avoid that disadvantage and to provide for the unwinding of a nonwoven fibrous web an apparatus in which an undesired loading of the web and a deformation of the web by such loading are avoided with simple means.

This object is accomplished in accordance with the invention in that the positioning drive is operated under the control of the controller in dependence on the pressure applied by the roll to the roll-bearing means.

Because the positioning drive for adjusting the bearings in height is controlled in dependence on the instantaneous pressure applied by the roll to the roll-bearing means rather than in dependence on the position of the roll, it is ensured that the pressure applied by the roll will be sufficient to ensure that the web will be carried along by the moving blanket whereas there is no risk of an overloading of the web. As the positioning drive is controlled in dependence on the pressure applied by the roll to the roll-bearing means, the load which is imposed on the web that has been unwound can be limited to a predetermined value. There are no restrictions regarding the design of the means which support the core of the roll, provided that said means are adapted to take up an adequate load. For instance, the core of the roll may be supported only at one end. In a simpler arrangement, the core of the roll is held in two bearings at opposite ends.

In order to permit a simple control of the positioning drive for adjusting the bearings for the roll core in dependence on the pressure applied by the roll to the roll-bearing means, the latter means may be supported by a sensor for measuring the load imposed on said roll-bearing means and said sensor may generate an actual-value signal and deliver said signal to the controller, to which a desired-value signal is also applied and which controls the positioning drive in dependence on the difference between the actual-value and desired-value signals. When the measured load imposed on the roll-bearing means indicates an excessive pressure applied by the roll to the roll-bearing means, the controller as a result of the comparison of the actual-value and desired-value signals will cause the positioning drive to increase the distance between the roll core and the roll-bearing means until the load imposed on the roll-bearing means has been decreased to the value which corresponds to the desired pressure to be applied. If the unwinding operation causes the load imposed on the roll-bearing means to decrease the required value, the positioning drive will be operated in the opposite sense so that the roll core will follow the decreasing radius of the roll and the roll will continue to apply the desired pressure to the roll-bearing means.

In another embodiment, a sensor for measuring the force applied by the roll core to at least one of the core bearings for mounting the roll core generates an actual-value signal and delivers the same to the controller, a desired-value signal generator associated with the controller is connected to a sensor for measuring the length of the web which has been unwound from the roll and the desired value, which depends on the instantaneous weight of the roll, is computed by the desired-value signal generator in dependence on the initial weight of the roll, the weight of the web per unit of length, and the measured length of the web which has been unwound. Data representing the initial weight of the roll and the weight of the web per unit of length are stored in the desired-value generator. For a web having a given weight per unit of length, the decrease of the weight of the roll can be determined in dependence on the measured length of the web which has been unwound from the roll and the instantaneous weight of the roll can then be determined as the difference between the initial weight of the roll and the weight decrease which has been ascertained. If a value which corresponds to the desired pressure to be applied by the roll to the roll-bearing means is subtracted from the instantaneous weight of the roll which has thus been ascertained, the result will constitute a desired value of the force applied by the roll core to the core bearings and the positioning drive associated with the core bearings can be operated in dependence on a comparison between the actual and desired values. When in that case the actual and desired values have been balanced, the core bearings mounting the roll core will always take up that portion of the weight which exceeds that load which is to be imposed by the roll on the roll-bearing means in order to ensure that a constant pressure will be applied by the roll to the roll-bearing means, so that the web will be subjected to a desired load.

To ensure a uniform distribution of the load imposed on the web through the width thereof, the roll core most remain parallel to the roll-bearing means during the adjustment of the roll core. For this reason the positioning drive associated with the core bearings mounting the roll core must be synchronized. This can be accomplished in a simple manner in that the first positioning drive associated with one core bearing is controlled by the controller in dependence on the pressure applied by the roll to the roll-bearing means and the second positioning drive associated with the other core bearing is controlled by a servomechanism in dependence on the position of the positioning drive which is controlled in dependence on the pressure applied. In that case the actual-value signal representing the elevation of said other core bearings is caused to match the desired-value signal representing the elevation of said one core bearing so that both core bearings will have the same elevation.

Figure 2:
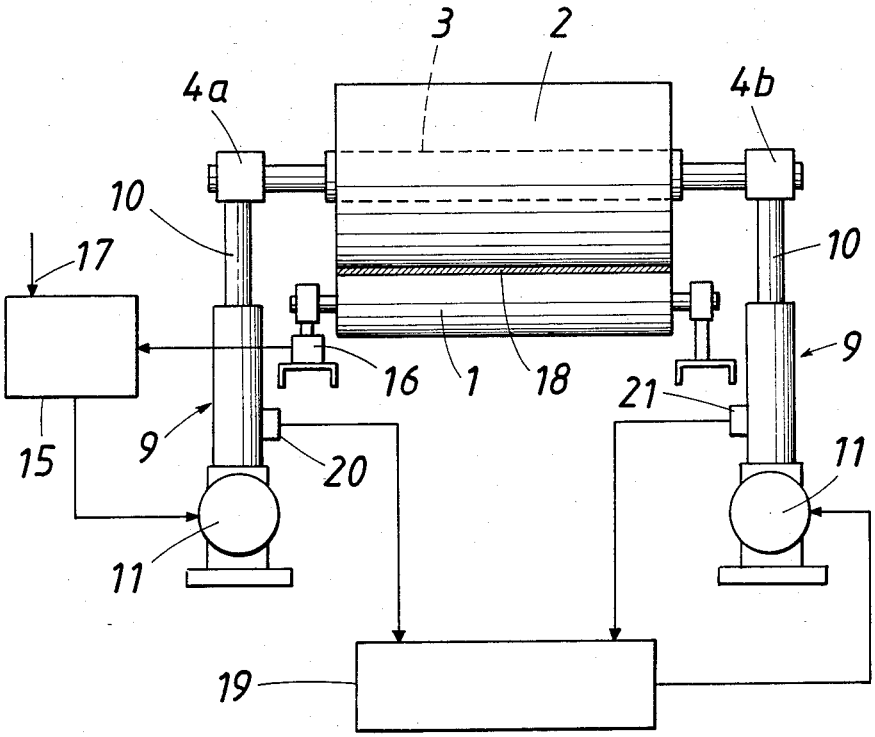
Figure 3:
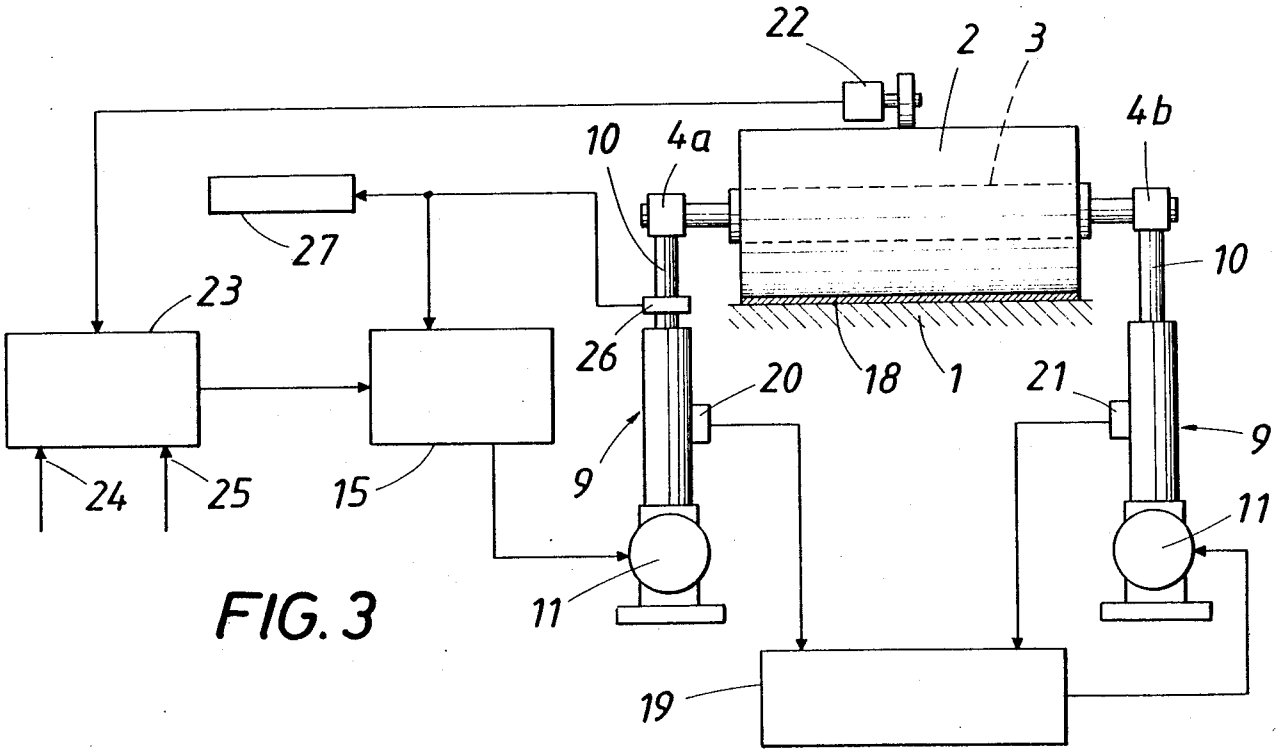

Illustrative embodiments of the invention are shown in a simplified form in the drawing, in which FIG. 1 is a side elevation showing apparatus according to the invention for unwinding a nonwoven fibrous web from a roll thereof, FIG. 2 is a block circuit diagram representing the operating control of the apparatus according to FIG. 1 and FIG. 3 is a block circuit diagram representing a modification of the operating control.

As is apparent from FIG. 1, apparatus for unwinding an unbonded nonwoven fibrous web from a roll 2 thereof comprises a roller 1, which constitutes roll-bearing means for supporting the roll 2 on the underside of its periphery. The roll 2 has been wound on a roll core 3, which is rotatably mounted at opposite ends in respective core bearings 4*a* and 4*b*. To facilitate the mounting of the roll core 3 in the core bearings 4*a* and 4*b*, each of the core bearings 4*a* and 4*b* consists of a bearing body 5 and two bearing rollers 6 supporting the roll core 3 at its adjacent journal 7 so that the roll core is freely rotatable but can be inserted in a simple manner. The bearing body 5 is slidably mounted on a vertical track 8 and can be adjusted along the track 8 by means of a positioning drive 9. In the embodiments shown by way of example, the positioning drive 9 comprises a power screw 10, which is driven by an electric motor 11. In the embodiment shown in FIG. 1, each power screw 10 is operatively connected to the associated core bearing 4*a* or 4*b* by a tension element 12, which may consist of a rope or chain and which is connected at opposite ends to a frame 13 and to the bearing body 5, respectively, and is trained around a deflecting pulley or sprocket 14, which is connected to the positioning drive 9. In that arrangement, operation of the positioning drive 9 will result in a displacement of the core bearing 4*a* or 4*b* along the vertical track 8. Because the core bearings 4*a* and 4*b* are adjustable in elevation, the contact pressure applied by the roll 2 can be controlled in such a manner that a relatively light load will be imposed on the web that has been withdrawn from the roll 2 at the roller 1 and that said load will not be changed by the decrease of the weight of the roll 2. For this purpose and as shown in FIGS. 2 and 3, the positioning drives 9 associated with the respective core bearings 4*a* and 4*b* are operated by a controller 15 in dependence on the pressure applied by the roll 2 to the roller 1.

In the arrangement shown in FIG. 2 this is accomplished in that the roller 1 is supported by a sensor 16, by which a signal representing the load imposed on the roller 1 is generated and delivered as an actual-value signal to the controller 15, which has an input terminal 17, at which a desired-value signal is delivered, which represents the load on the roller 1 which corresponds to the desired pressure to be applied. In dependence on the difference between the actual-value and desired-value signals the electric motor 11 is operated to adjust the power screw 10 until a load corresponding to the desired pressure is imposed on the roller 1. That part of the weight of the roll 2 which is in excess of the load imposed on the roller 1 is taken up by means of the core bearings 4*a* and 4*b*. It will be understood that the weight of the roll consists of the weight of the roll core and of the web which is wound on the roll core.

To ensure that the load imposed on the web being unwound from the roll 2 will be uniformly distributed throughout the width of the web so that the latter can be uniformly applied to a conveyor belt 18 which is moved past the roll 2 under the same, the roll core 3 must remain parallel to the axis of the roller 1 during the adjustment of the roll core 3. For this reason the two positioning drives 9, 9 are synchronized by a servomechanism 19, which comprises a desired-value signal generator 20 for sensing the position of the positioning drive that is directly controlled by the controller 15, and an actual-value signal generator 21 for sensing the position of the positioning drive 9 which is associated with the core bearing 4*b*. In dependence on the difference between the actual-value and desired-value signals generated by the generators 20 and 21, respectively, that servomechanism causes the electric motor 11 of the positioning drive 9 associated with the bearing 4*b* to move the bearing 4*b* so that it has always the same elevation as the bearing 4*a*.

In the embodiment shown in FIG. 3, different means are provided for controlling the positioning drives in dependence on the pressure applied by the roll 2. The weight of the roll which is in excess of the weight that is required for the application of the desired pressure by roll 2 must be taken up by means of the core bearings 4*a* and 4*b*. For this reason that weight portion which is to be taken up by means of the core bearings 4*a* and 4*b* can be measured in dependence on the forces applied by the roll core 3 to said core bearings 4*a* and 4*b*, provided that the instantaneous weight of the roll 2 can be determined. For this purpose a sensor 22 is provided, which measures the length of the web that has been unwound from the roll 2 and the measured length together with the predetermined weight of the web per unit of length are used in a computation of the weight of the web which has been unwound. When the weight which is required for the application of the desired pressure by the roll 2 is subtracted from the instantaneous weight of the roll, the difference will constitute the desired value of the bearing forces to be taken up by the bearings 4a and 4b. In the embodiment shown in FIG. 3, the controller 15 is connected to a desired-value signal generator 23, which receives from the sensor 22 a signal representing the measured length of the web which has been unwound and which has an input 24 for receiving data representing the weight of the web per unit of length and an input 25 for receiving data representing the initial weight of the roller. In accordance with a program, the signal generator 23 generates a desired-value signal and delivers it to the controller 15. It will be understood that the pressures to be applied by different rolls may differ and data representing such different pressures may be delivered to the desired-value signal generator 23. The actual-value signal is generated by a sensor 26, which measures the bearing force taken up by the core bearing 4a. One-half of the weight to be taken up by means of the bearings 4a and 4b is taken up by the bearing 4a. The signal representing the value measured by the sensor 26 is delivered as an actual-value signal to the controller 15, which controls the positioning drive 9 associated with the bearing 4a in dependence on the difference between the actual-value and desired-value signals. The positioning drive 9 associated with the other bearing 4b is operated by the servomechanism 19 in synchronism with the first-mentioned positioning drive. Alternatively, the sensor 26 may be used to measure the initial weight of the roll if the value measured before the application of the roll 2 to the roller 1 is recorded, e.g., by a suitable weight sensor 27, which may be directly connected to an input terminal 25 of the desired-value signal generator 23.

If the positioning drive 9 for each of the core bearings 4a and 4b is connected to the associated core bearing by means of a tension element 12, as is shown in FIG. 1, the sensor 26 for measuring the bearing force applied to the core bearings may be responsive to the tension of the tension element 12 because the tension of said tension element is a measure of the force applied to the core bearings.

It will be understood that the invention may be used to equal advantage also in an arrangement in which the roll core is driven rather than freely rotatably mounted. Those advantages which reside in the restriction of the load on the web will also be obtained if a web is wound on rather than unwound from a roll. For this reason the proposed apparatus for unwinding a web from a roll thereof can also be used to wind a web on a roll thereof.

What is claimed is:

1. In apparatus for unwinding a nonwoven fibrous web from a roll thereof, which comprises a roll core which extends axially through said roll and has journal means protruding from said roll at least at one end thereof, roll-bearing means for supporting said roll on the underside of its periphery whereby the roll exerts a contact pressure on the roll-bearing means, core-mounting means adapted to rotatably mount said journal means and being adjustable in elevation relative to said roll-bearing means, a controller, and positioning drive means for adjusting said core-mounting means in elevation relative to said roll-bearing means under the control of said controller, the improvement comprising signal-generating means including a sensor directly sensing the contact pressure exerted by the roll on the roll-bearing means and generating an actual-value signal corresponding to the sensed contact pressure between said roll and said roll-bearing means, means connecting a first input of said controller to said sensor to receive said actual-value signal, a second input of said controller receiving a desired-value signal corresponding to a predetermined contact pressure, and said controller being operable to control said positioning drive means for adjusting said core-mounting means in response to any difference between said actual-value and desired-value signals to maintain the predetermined contact pressure between said roll and said roll-bearing means.

2. In apparatus for unwinding a nonwoven fibrous web from a roll thereof, which comprises a roll core which extends axially through said roll and has journal means protruding from said roll at both ends thereof, roll-bearing means for supporting said roll on the underside of its periphery whereby a contact pressure is generated between the roll and the roll-bearing means, core-mounting means comprising two core bearings for receiving said journal means, the core bearings being adapted to rotatably mount said journal means and being adjustable in elevation relative to said roll-bearing means, a controller, and first and second positioning drives for adjusting respective ones of said core bearings in elevation relative to said roll-bearing means under the control of the controller, the improvement comprising signal-generating means for generating an output signal which depends on the contact pressure between said roll and said roll-bearing means, means connecting said controller to said signal-generating means to receive said output signal and to said first positioning drive for adjusting the respective core bearing to maintain a predetermined contact pressure between said roll adjacent the respective core bearing and said roll-bearing means in response to said output signal, and a servomechanism comprising a desired-value signal generator for generating a signal representing the adjusted position of said first positioning drive and an actual-value signal generator for generating an actual-value signal representing the position of the second positioning drive, said servomechanism being operable to control said second positioning drive in dependence on the difference between said actual-value signal and said desired-value signal.

3. In apparatus for unwinding a nonwoven fibrous web from a roll thereof, which comprises a roll core which extends axially through said roll and has journal means protruding from said roll at least at one end thereof, roll-bearing means for supporting said roll on the underside of its periphery whereby a contact pressure is generated between the roll and the roll-bearing means, core-mounting means adapted to rotatably mount said journal means and being adjustable in elevation relative to said roll-bearing means, a controller, and positioning drive means for adjusting said core mounting means in elevation relative to said roll-bearing means under the control of the controller, the improvement comprising signal-generating means comprising a sensor supporting the roll-bearing means, directly sensing said contact pressure and generating an actual-value output signal which depends on the contact pressure between said roll and said roll-bearing means and represents the load applied by said roll to said roll-bearing means, means connecting said controller to said signal-generating means to receive said output signal, a desired-value signal generator for generating a desired-value signal representing a load which corresponding to a predetermined contact pressure, means connecting said controller to said desired-value signal generator to receive the desired-value signal, and means connecting said controller to said positioning drive means for adjusting the core-mounting means to maintain the predetermined contact pressure between said roll adjacent the respective core bearing and said roll-bearing means in dependence on the difference between said actual-value signal and said desired-value signal.

4. In apparatus for unwinding a nonwoven fibrous web from a roll thereof, which comprises a roll core which extends axially through said roll and has journal means protruding from said roll at least at one end thereof, roll-bearing means for supporting said roll on the underside of its periphery whereby a contact pressure is generated between the roll and the roll-bearing means, core-mounting means adapted to rotatably mount said journal means and being adjustable in elevation relative to said roll-bearing means, a controller, and positioning drive means for adjusting said core mounting means in elevation relative to said roll-bearing means under the control of the controller, the improvement comprising signal-generating means comprising a sensor directly sensing said contact pressure for generating an actual-value signal representing the force applied by said journal means to said core-mounting means and depending on the contact pressure between said roll and said roll-bearing means, a length sensor for generating a length signal representing the length of said web which has been unwound from said roll, a desired-value signal generator arranged to receive said length signal and adapted to store data representing the initial weight of said roll and the weight of said web per unit of length, the desired-value signal generator being operable to generate a desired-value output signal in dependence on said length signal and said stored data, and means connecting said controller to said desired-value signal generator to receive said output signal and to said positioning drive means for adjusting said core-mounting means to maintain a predetermined contact pressure between said roll and said roll-bearing means in dependence on the difference between said actual-value signal and said desired-value signal.

* * * * *